US006283083B1

(12) United States Patent
Kawasaki et al.

(10) Patent No.: US 6,283,083 B1
(45) Date of Patent: Sep. 4, 2001

(54) LUBRICATING CONSTRUCTION FOR OUTBOARD MOTOR

(75) Inventors: Naoki Kawasaki; Mitsuhiko Ohta, both of Shizuoka-Ken (JP)

(73) Assignee: Suzuki Motor Corporation (JP)

( * ) Notice: Subject to any disclaimer, the term of this patent is extended or adjusted under 35 U.S.C. 154(b) by 0 days.

(21) Appl. No.: 09/448,575

(22) Filed: Nov. 23, 1999

(30) Foreign Application Priority Data

Mar. 30, 1999 (JP) ..... 11-090219

(51) Int. Cl.[7] ..... F01M 3/04
(52) U.S. Cl. ..... 123/196 M; 123/196 W
(58) Field of Search ..... 123/196 R, 196 M, 123/196 W, 90.34, 90.35, 90.36; 184/6.9, 6.18; 440/68, DIG. 900

(56) References Cited

U.S. PATENT DOCUMENTS 1,446,775 * 2/1923 Wahl ..... 123/196 W
4,549,520 * 10/1985 Tamba et al. ..... 123/572
4,800,850 * 1/1989 Yoshida et al. ..... 123/90.16
4,881,497 * 11/1989 Matayoshi et al. ..... 123/90.34
4,926,814 * 5/1990 Bonde ..... 123/196 W
5,003,937 * 4/1991 Matsumoto et al. ..... 123/90.12
5,687,686 * 11/1997 Takahashi ..... 123/195 P
5,704,315 * 1/1998 Tsuchida et al. ..... 123/90.16
5,988,129 * 11/1999 Prior et al. ..... 123/90.34
6,152,119 * 11/2000 Hoshiba et al. ..... 123/572

FOREIGN PATENT DOCUMENTS 09-049411 2/1997 (JP) .

* cited by examiner

*Primary Examiner*—Noah P. Kamen
*Assistant Examiner*—Hai Huynh
(74) *Attorney, Agent, or Firm*—Morrison Law Firm

(57) ABSTRACT

An oil chamber at an upper portion of an outboard engine provides lubrication to a valve gear device within a cylinder head of the outboard engine. Oil passages provide engine oil into the oil chamber. Oil dropping passages on the bottom of the oil chamber permits the oil to flow vertically from the oil chamber into the cylinder head. The oil dropping passages are positioned above the valve end sections to provide sufficient lubrication to the valve end sections of the engine. As a result, the valve end sections are made from material of normal hardness, thereby reducing manufacturing costs.

11 Claims, 8 Drawing Sheets

LUBRICATING CONSTRUCTION FOR OUTBOARD MOTOR

BACKGROUND OF THE INVENTION

The present invention relates to a lubricating construction for outboard motors. More specifically, the present invention relates to a lubricating construction for outboard motors which supplies a sufficient amount of a lubricating oil to valve end sections of the outboard motor.

A four-cycle engine includes a valve gear device provided in a cylinder head. Respective sliding portions in the valve gear device are continuously subjected to lubrication with a lubricating oil conducted by way of oil passages.

In conventional outboard engines, so-called valve end sections, that is, contact points between heads of intake and exhaust valves and ends of rocker arms for opening and closing the valves, in a valve gear device lack means for supplying a lubricating oil directly thereto. Lubrication of the valve end sections depends upon the splashing of a lubricating oil which scatters in the cylinder head.

A cam shaft is vertically positioned in a conventional engine, such as an engine for outboard motors, in which a crank shaft is positioned vertically. A thrust force acting in an axial direction of the cam shaft is born by a thrust bearing construction provided at a lowermost portion of a cylinder head, in which the cam shaft is housed. The thrust bearing construction supports a lower end of the cam shaft.

However, lubrication of valve end sections cannot be adequately performed only by the splashing of a lubricating oil which scatters in a cylinder head. Specifically, with a vertical-type engine, such as an engine mounted on an outboard motor, upwardly positioned valve end sections for cylinders cannot be adequately supplied with a lubricating oil. As a result, such valve end sections must be have a greater hardness relative to the normal case. This increases manufacturing costs and prevents use of common parts.

Where a thrust bearing construction is arranged at a lowermost portion of a cylinder head, it is difficult to mount and dismount a cam shaft. This results in an unfavorable assembly and maintenance quality.

Also, in the case where a thrust bearing construction is arranged above a cylinder head, a sufficient amount of lubricating oil does not spread over sliding surfaces of the thrust bearing construction and the cam shaft for the above described reasons. Therefore, such conventional arrangements are unfavorable due to the possibility that abrasion may result on poorly lubricated sliding surfaces.

OBJECTS AND SUMMARY OF THE INVENTION

It is an object of the present invention to provide a lubricating construction for outboard motors which overcomes the foregoing problems.

It is a further object of the present invention to provide a lubricating construction for outboard motors which is capable of supplying a sufficient amount of lubricating oil to valve end sections of the engine.

It is another object of the present invention to provide a lubricating structure for outboard motors which enhances the layout of a thrust bearing mechanism.

To solve the above described problems, in one aspect of the present invention, a lubricating construction for outboard motors, having a valve gear device, such as a cam shaft, provided in a cylinder head of an engine and a drive mechanism of the cam shaft provided at a lower end of the cam shaft, includes a closed space formed above a bearing boss, which supports an upper end of the cam shaft. This closed space is integrally formed with the cylinder head. Oil passages are provided in the cylinder head for conducting a lubricating oil into the closed space.

Also, to solve the above described problems, in another aspect of the present invention, a lubricating construction for outboard motors, having a valve gear device, such as a cam shaft, in a cylinder head of an engine and a drive mechanism of the cam shaft provided at a lower end of the cam shaft, includes a cover member provided above a bearing boss, which supports an upper end of the cam shaft. A closed space is provided in the cover member to be separate from the cylinder head. Oil passages are provided in the cylinder head for conducting a lubricating oil into the closed space.

Further, to solve the above described problems, in a further aspect of the present invention, a lubricating construction for outboard motors, having a valve gear device, such as a cam shaft, provided in a cylinder head of an engine and a drive mechanism of the cam shaft provided at an upper end of the cam shaft, includes a seal housing provided above the cylinder head to support an upper end of the cam shaft. A closed space is provided in the seal housing to be separate from the cylinder head. Oil passages are provided in the cylinder head for conducting a lubricating oil into the closed space.

In a feature of the present invention, a lubricating construction for outboard motors further includes oil dropping passages formed on a lower surface of the closed space immediately above the valve gear device. The lubricating oil in the closed space drops, through these oil dropping passages, onto the valve gear device.

Briefly stated, the present invention provides an oil chamber at an upper portion of an outboard engine which provides lubrication to a valve gear device within a cylinder head of the outboard engine. Oil passages provide engine oil into the oil chamber. Oil dropping passages on the bottom of the oil chamber permits the oil to flow from the oil chamber into the cylinder head. The oil dropping passages are positioned to provide sufficient lubrication to the valve end sections of the engine. As a result, the valve end sections are made from material of normal hardness, thereby reducing manufacturing costs.

According to an embodiment of the present invention, there is provided an outboard motor engine comprising: a cylinder head having a valve gear device; the valve gear device includes a cam shaft; at least one bearing boss supporting the cam shaft in the cylinder head; a cavity above an uppermost bearing boss; the uppermost bearing boss supporting an upper end of the cam shaft; and oil passages for conducting oil into the cavity.

According to a feature of the present invention, there is provided an outboard motor engine comprising: a cylinder head having a valve gear device; the valve gear device includes a cam shaft; at least one bearing boss supporting the cam shaft in the cylinder head; a cavity above an uppermost bearing boss; the uppermost bearing boss supporting an upper end of the cam shaft; oil passages for conducting oil into the cavity; oil dropping passages in a lower portion of the cavity, wherein oil is communicated between the cavity and the cylinder head; and the oil dropping passages being located such that oil dropping from the oil dropping passages lubricates at least one of the at least one intake valve, the at least one exhaust valve, the intake rocker arm, the exhaust rocker arm, the intake rocker shaft, the exhaust rocker shaft, and the cam shaft.

DETAILED DESCRIPTION OF THE INVENTION

Embodiments of the invention will be described hereinafter with reference to the accompanying drawings.

Figure 1:
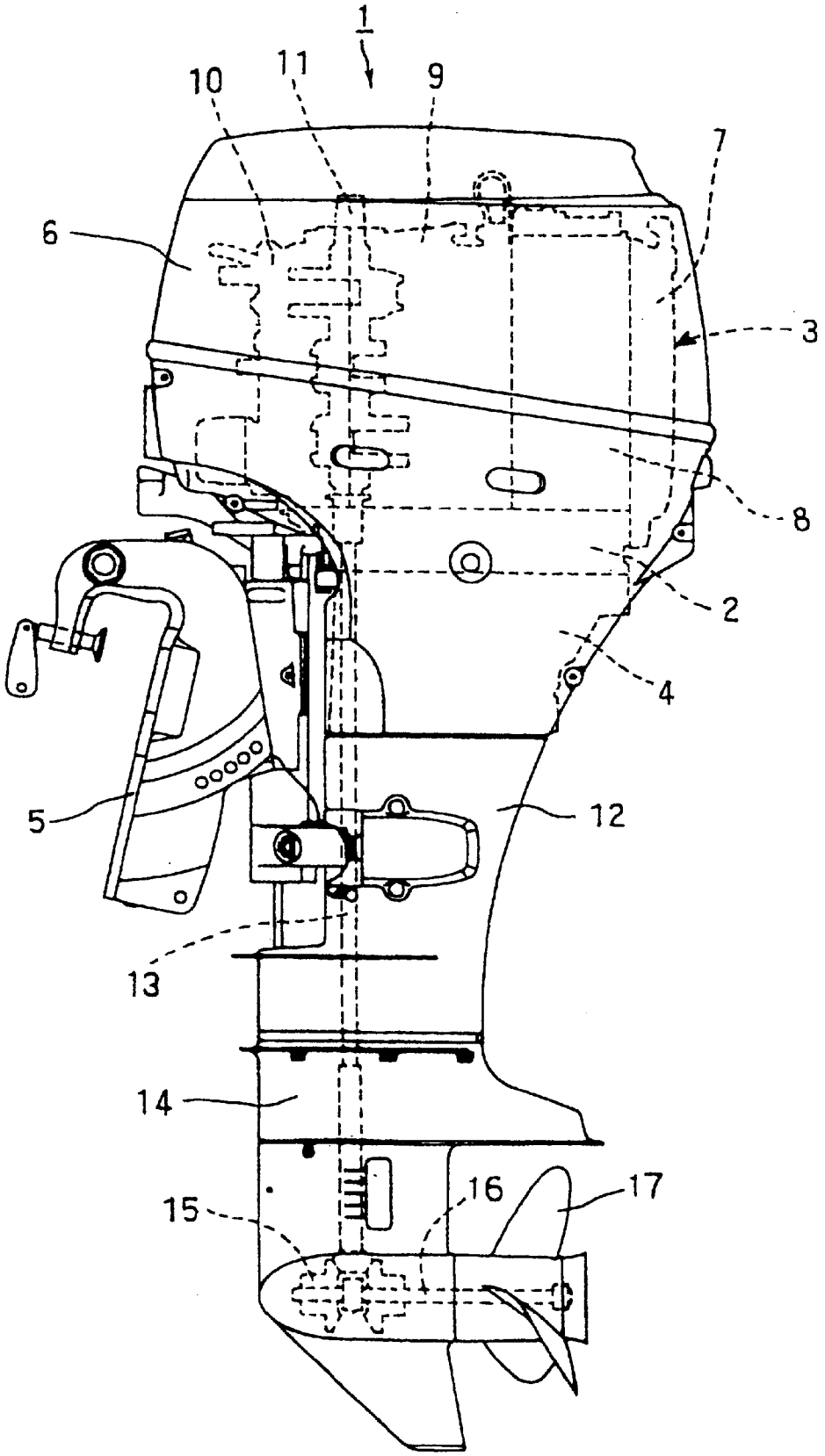
FIG. 1 is a left side view showing of an outboard engine according to an embodiment of a the present invention.
Figure 2:
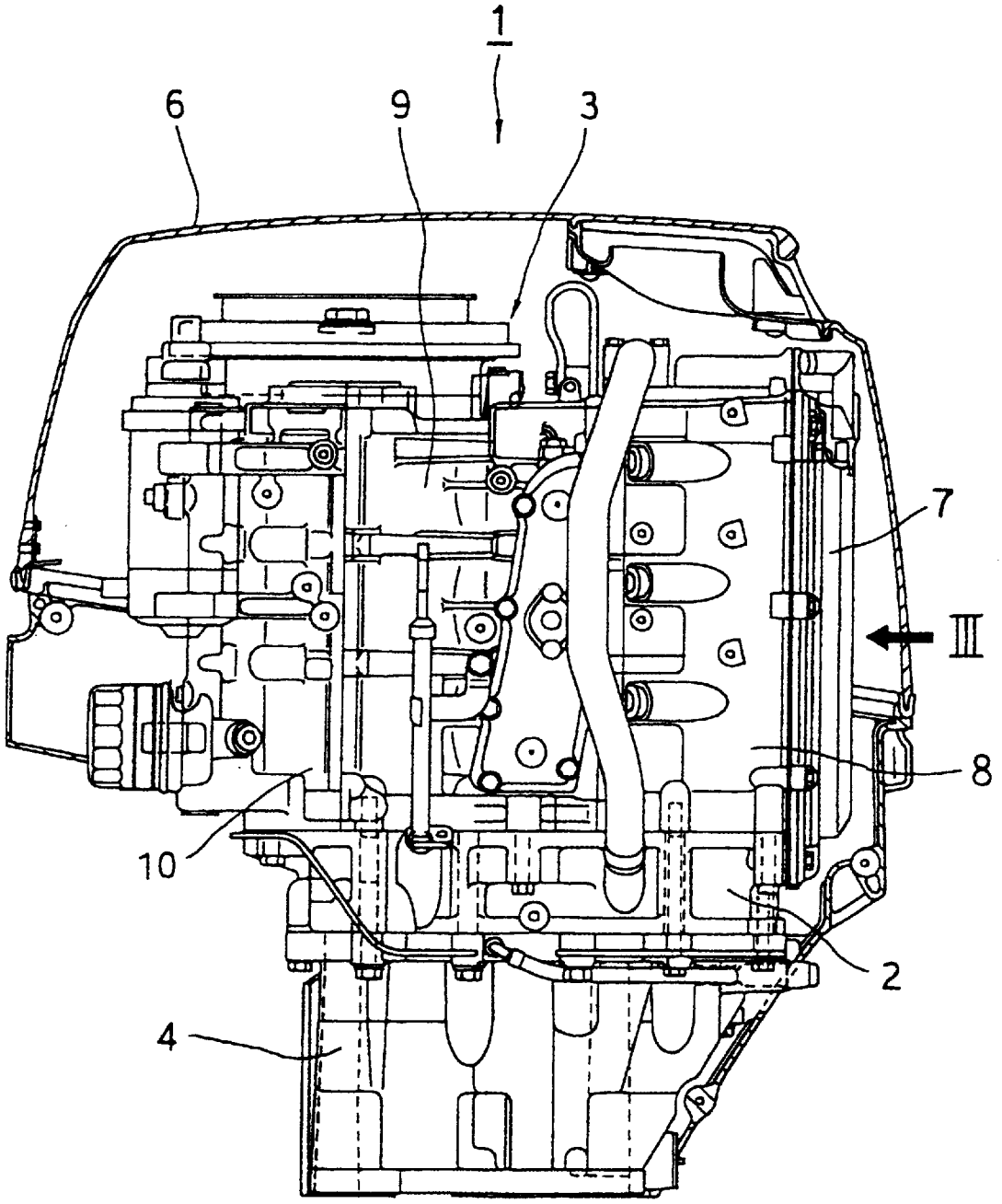
FIG. 2 is an enlarged side view showing an engine section of the outboard engine of FIG. 1.

Referring to FIGS. 1 and 2, an outboard motor 1 includes an engine 3 enclosed by an outboard motor cover 6. An engine holder 2, positioned below engine 3, provides support for engine 3 inside outboard motor cover 6. An oil pan 4 is located below engine holder 2. A bracket 5 is provided on, for example, engine holder 2, to mount outboard motor 1 on a transom (not shown) of a hull of a boat. Further, the engine 3 is enclosed by an outboard motor cover 6.

Engine 3 is preferably a water-cooled 4-cycle 3-cylinder engine including a cylinder head cover 7, a cylinder head 8, a cylinder block 9, and a crankcase 10. The respective cylinders (not shown) are arranged vertically. In addition, in this embodiment of the present invention, the cylinder uppermost disposed is referred to as the first cylinder, with the remaining cylinders hereinafter referred to as the second cylinder, the third cylinder, and so on, for the sake of convenience.

Crank case 10 is provided on a foremost part of engine 3. That is, on the left side as shown in FIGS. 1 and 2. Cylinder block 9 is disposed rearwardly (on a right side) of crank case 10. Cylinder head 8 is also disposed rearwardly of cylinder block 9. Further, a rear opening of the cylinder head 8 is covered by cylinder head cover 7. Engine 3 is a vertical-type, in which a crank shaft 11 is arranged substantially vertically in reference to crank case 10 and cylinder block 9.

A shaft housing 12 is positioned below oil pan 4. A drive shaft 13 is substantially vertical in engine holder 2, oil pan 4, and shaft housing 12. An upper end of drive shaft 13 connects to a lower end of crank shaft 11. Drive shaft 13 extends downward in shaft housing 12 to drive a propeller 17 through a bevel gear 15, provided on a lower part of shaft housing 12 and a propeller shaft 16, in a gear casing 14.

Figure 3:
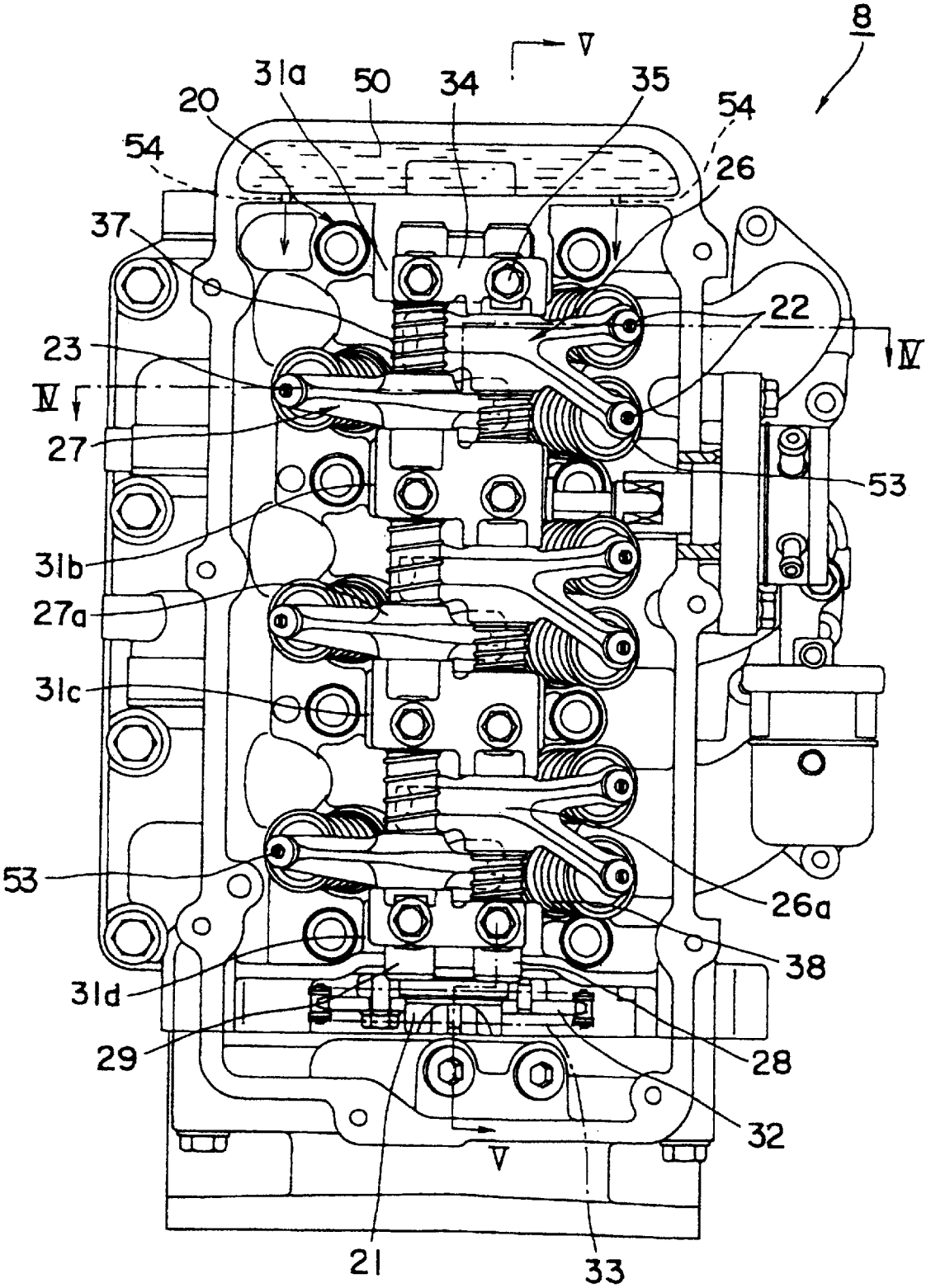
FIG. 3 is a rear view showing a cylinder head of the outboard engine of FIG. 1 according to a first embodiment of the present invention as viewed from the direction of arrow III.
Figure 4:
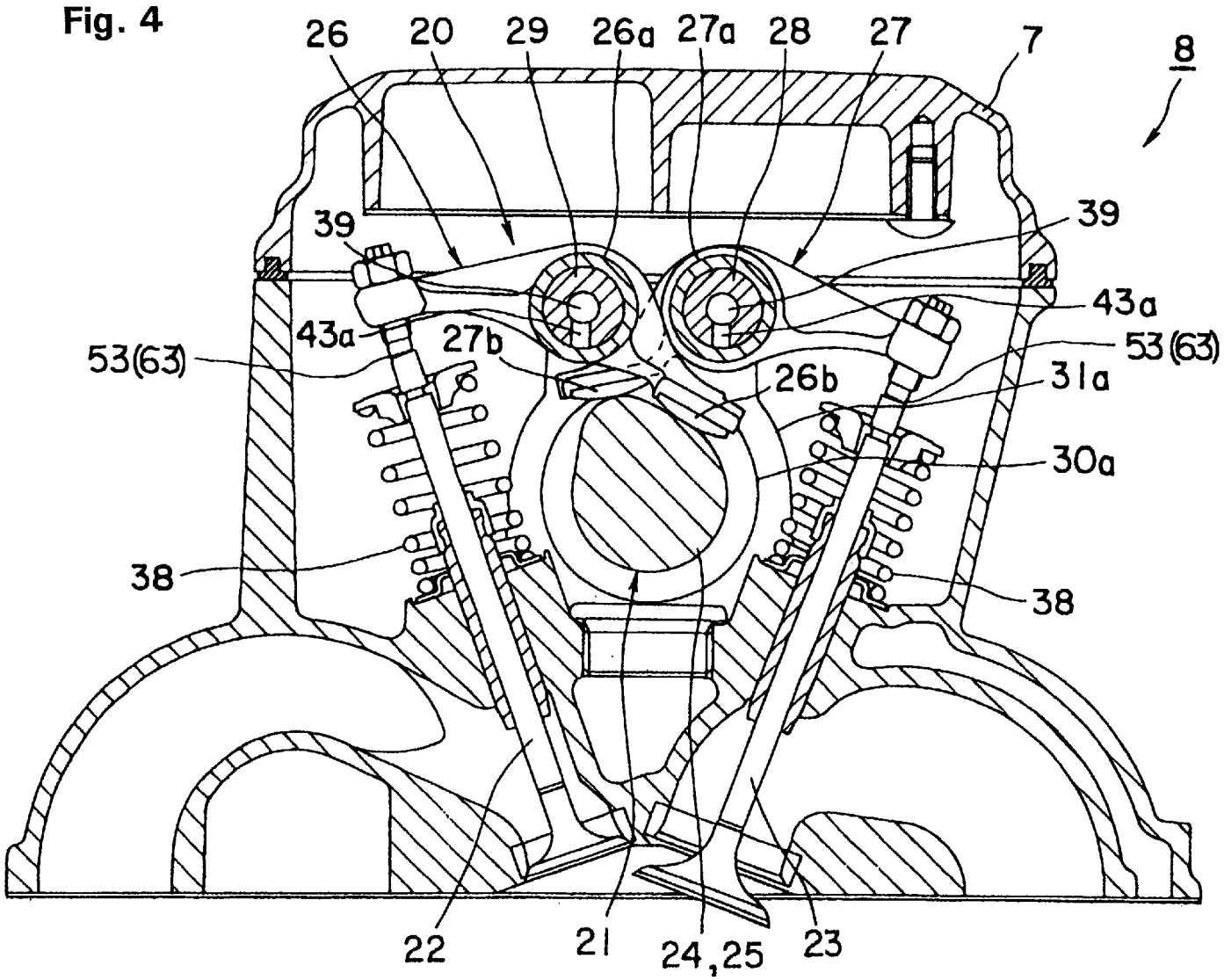
FIG. 4 is a cross sectional view taken along the line IV—IV in FIG. 3.
Figure 5:
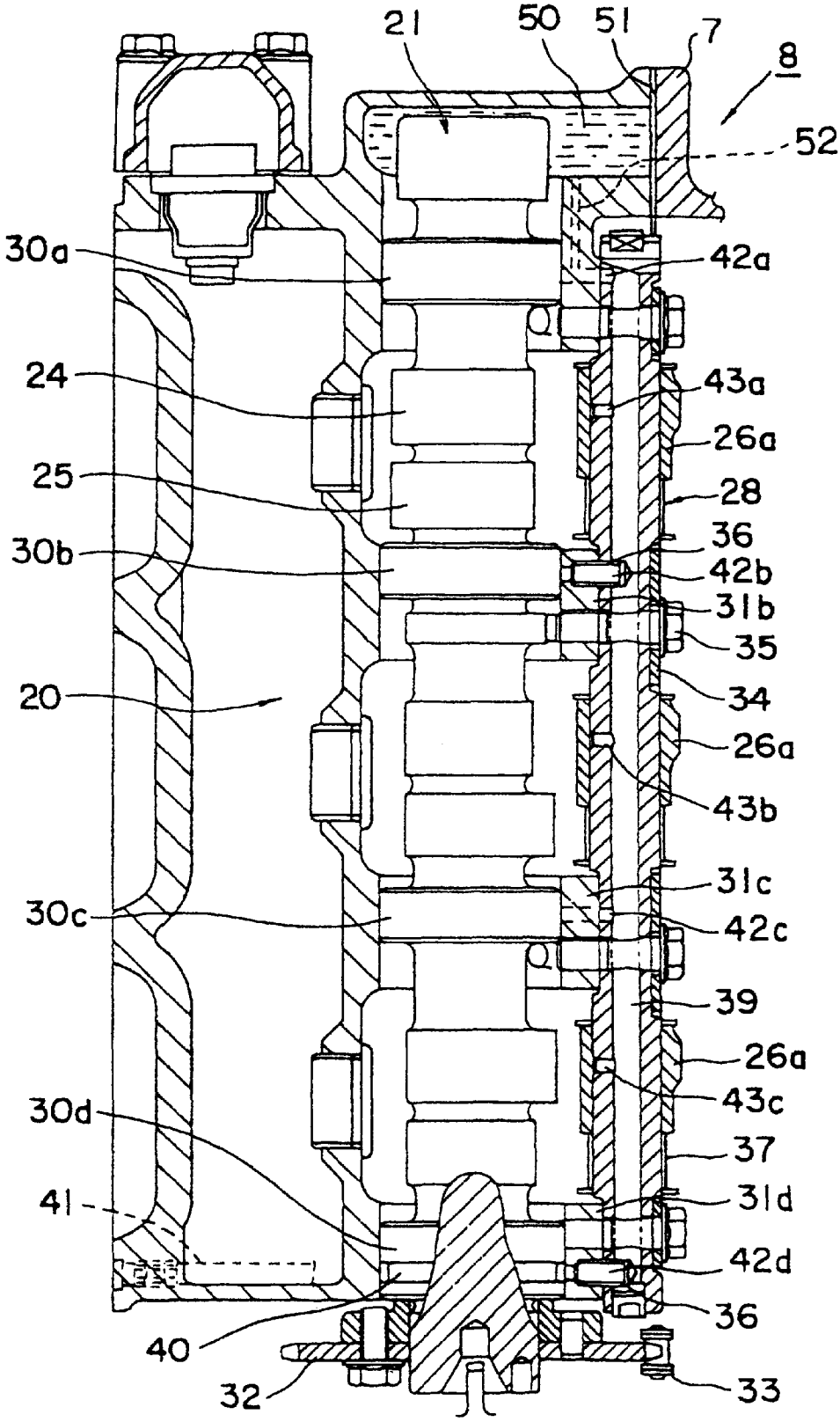
FIG. 5 is a cross sectional view taken along the line V—V in FIG. 3.

Referring to FIGS. 3 to 5, a valve gear device 20 is in cylinder head 8 of engine 3. Valve gear device 20 includes, as its main components, a cam shaft 21 in parallel to crank shaft 11, intake valves 22, and exhaust valves 23. Intake and exhaust rocker arms 26 and 27 transmit revolutions of intake and exhaust cams 24 and 25 to both intake and exhaust valves 22 and 23. Intake and exhaust rocker shafts 28 and 29 rotatably support intake and exhaust rocker arms 26 and 27.

Valve gear device 20 of engine 3 in one embodiment of the present invention includes two intake valves 22 and one exhaust valve 23 for each cylinder. A cam arrangement, having of one intake cam 24 and one exhaust cam 25 for each cylinder, is provided on cam shaft 21 to correspond to intake valves 22 and exhaust valve 23. Also, in this embodiment of the present invention, opening and closing of both intake valves 22 is effected by one rocker arm 26.

Bearing journals 30*a* to 30*d* are provided on cam shaft 21 between both ends of cam shaft 21, between the cam arrangements of the first and second cylinders, and between the cam arrangements of the second and third cylinders. Cylindrical-shaped bearing bosses 31*a* to 31*d*, integrally formed with cylinder head 8, rotatably support bearing journals 30*a* to 30*d*. Further, bearing bosses 31*a* to 31*d* are in positions corresponding to their respective bearing journals 30*a* to 30*d*. That is, bearing bosses 31*a* to 31*b* are in positions between their respective cylinders and at upper and lower ends of cylinder head 8. In addition, on a lower end of cam shaft 21, a cam driven gear 32, which is a drive mechanism of cam shaft 21, transmits rotation to crank shaft 11 through a length of a timing chain 33.

The respective rocker shafts 28 and 29 are mounted on and secured to bearing bosses 31*a* to 31*d* by bolts 35 through brackets 34. Hereupon, hollow knock pins 36 are used to position the respective rocker shafts 28 and 29, for example, between the first and second cylinders and on bearing boss 31*b*, and below the third cylinder on bearing boss 31*d*. Supports 26*a* and 27*a* of the respective rocker arms 26 and 27 are rotatably born by the respective rocker shafts 28 and 29. Spacer springs 37 are between brackets 34, which secure rocker shafts 28 and 29, and supports 26*a* and 27*a* of rocker arms 26 and 27, to position rocker arms 26 and 27 on rocker shafts 28 and 29.

One end of the respective rocker arms 26 and 27 abuts against heads of the respective valves 22 and 23. Rotation of cam shaft 21 causes intake cam 24 and exhaust cam 25 to push up cam follower surfaces 26*b* and 27*b*, formed on the other ends of the respective rocker arms 26 and 27, to open and close the respective valves 22 and 23. In addition, valve springs 38 maintain the respective valves 22 and 23 in closed position at all times.

Pressure oil ducts 39 axially extend within rocker shafts 28 and 29. Also, an oil groove 40 is circumferentially positioned on an outer peripheral surface of bearing journal 30*d* provided at the lower end of cam shaft 21. An oil introduction channel 41, opened (not shown) toward oil groove 40, is provided on an inner peripheral surface of bearing boss 31*d*, which supports bearing journal 30*d*. A lubricating oil is pressure fed by means of an oil pump (not shown) to oil groove 40.

A hole for knock pin 36, located on bearing boss 31*d* below the third cylinder, is opened to an inner peripheral surface of bearing boss 31*d* opposite to oil groove 40 so that the lubricating oil conducted to oil groove 40 through an oil passage 42*d* defined by hollow knock pin 36 is introduced into pressure oil ducts 39 formed in rocker shafts 28 and 29. Oil passages 42*a* to 42*c* extend toward an inner peripheral surfaces of bearing bosses 31*a* to 31*c* from pressure oil ducts 39 to provide lubrication on the sliding surfaces of bearing bosses 31*a* to 31*d* and bearing journals 30*a* to 30*d*.

In addition, an oil passage 42*b*, formed in bearing boss 31*b* between the first and second cylinders, also serves as a hole for knock pin 36, similar to oil passage 42*d* on bearing boss 31*d* below the third cylinder. Further, oil passages 43*a* to 43*c* extend toward sliding surfaces of supports 26*a* and 27*a* of the respective rocker arms 26 and 27 from pressure oil ducts 39.

An oil chamber 50, integral with cylinder head 8, is enclosed at its opening 51 by cylinder head cover 7. Oil chamber 50 is above bearing boss 31*a*, supporting an upper end of cam shaft 21. An oil branch passage 52, which is another oil passage leading toward oil chamber 50, connects to a midsection of oil passage 42*a*, which is closest to oil chamber 50 and extends toward bearing journal 30*a* at the upper end of cam shaft 21. Oil flows among oil passages 42*a* to 42*d*, extending toward the inner peripheral surfaces of bearing bosses 31*a* to 31*d* from pressure oil ducts 39 of rocker shafts 28 and 29.

Oil dropping passages 54 are formed on a lower surface of oil chamber 50 immediately above valve end sections 53 positioned at contact points between heads of intake valves 22 and exhaust valve 23 and ends of rocker arms 26 and 27, which operate to open and close intake and exhaust valves 22 and 23.

Figure 6:
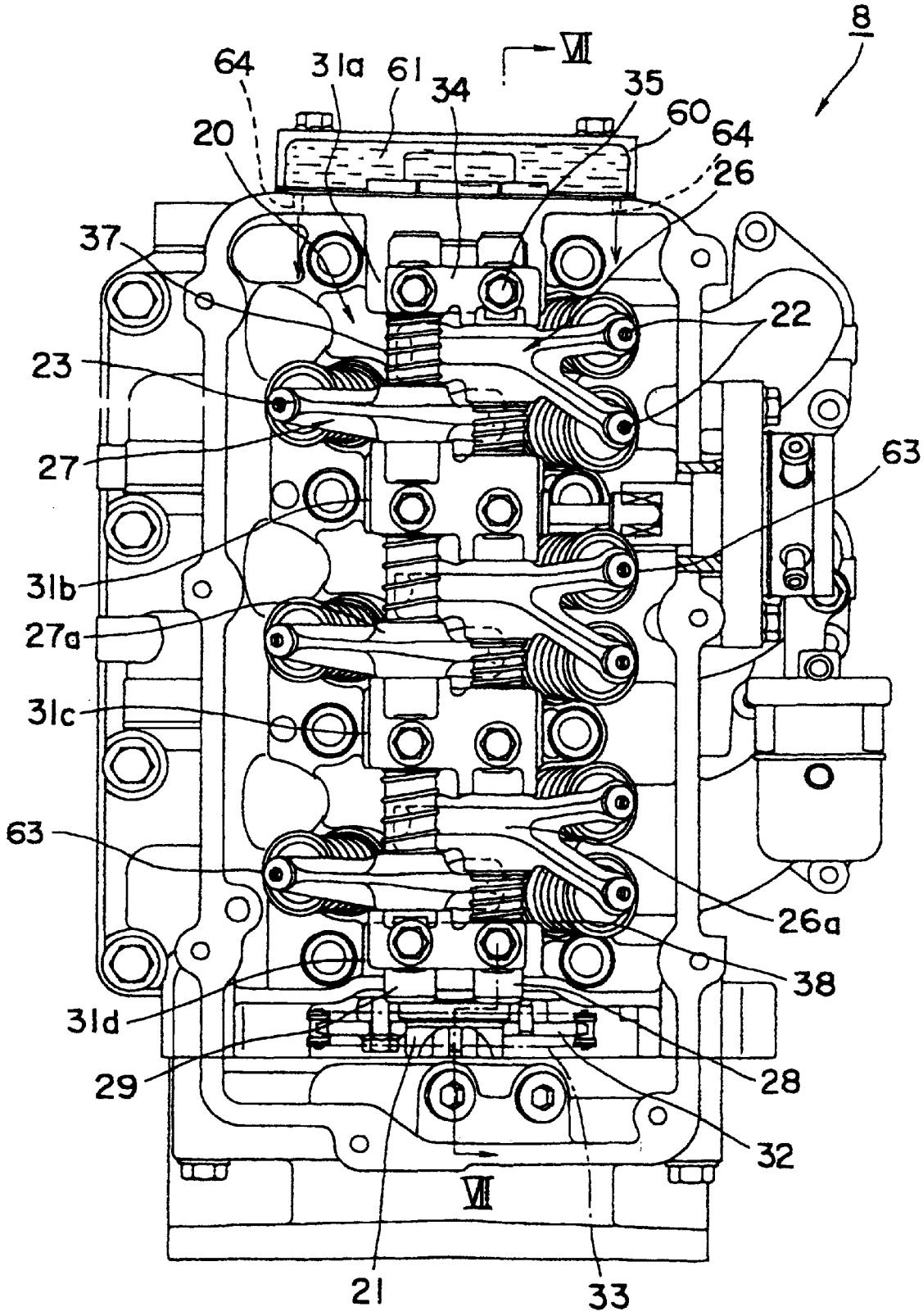
FIG. 6 is a rear view showing a cylinder head of an outboard engine according to a second embodiment of the present invention.
Figure 7:
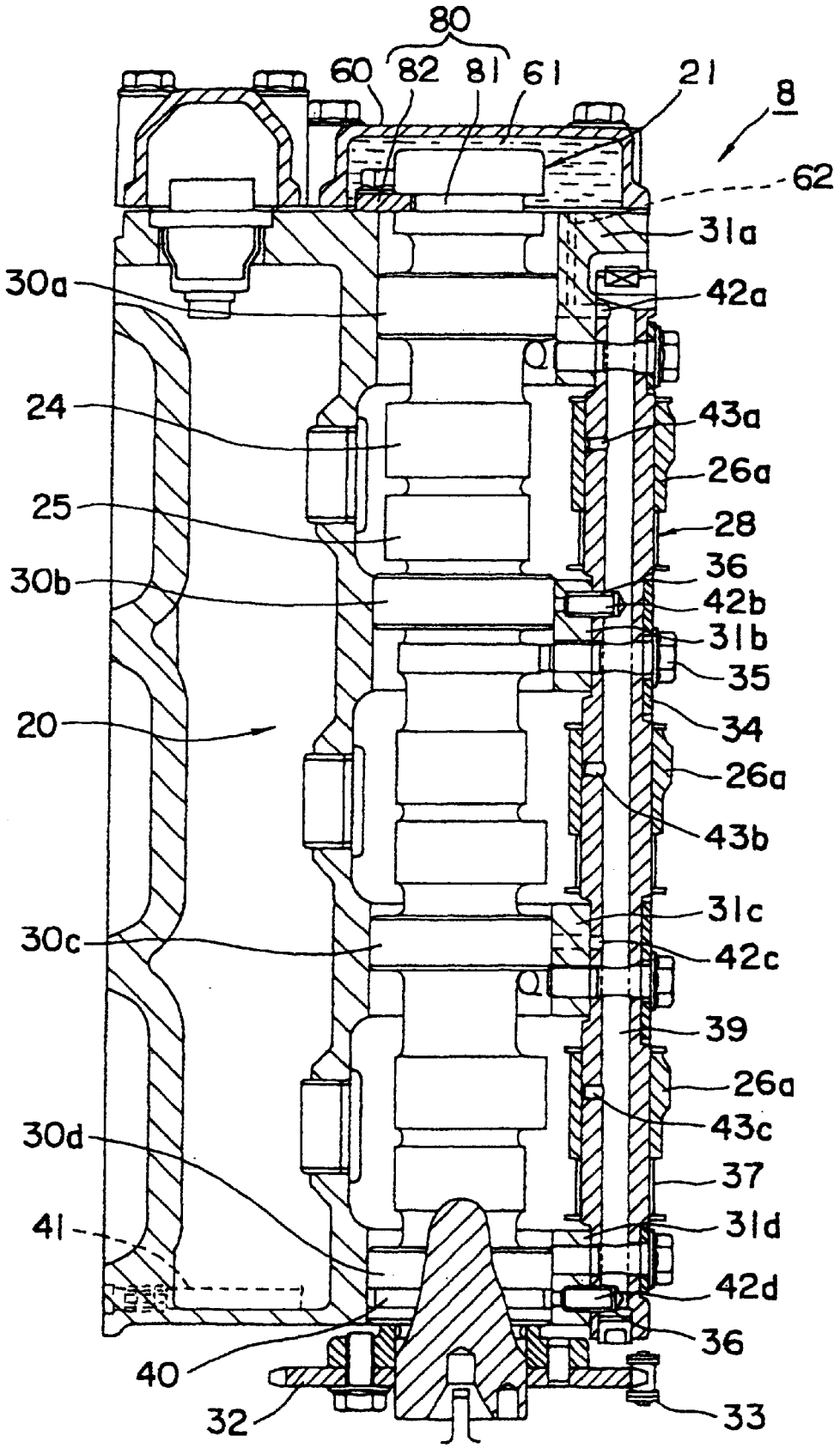
FIG. 7 is a cross sectional view taken along the line VII—VII in FIG. 6.

Referring to FIGS. 6 and 7, in an alternate embodiment of the present invention, an upper cover 60 is formed above bearing boss 31*a*, which supports an upper end of cam shaft 21, to create an oil chamber 61. An oil branch passage 62, which is another oil passage leading from oil chamber 61, is formed from at a midsection in oil passage 42*a*, which extends toward bearing journal 30*a* at the upper end of cam shaft 21. As in the first embodiment, the oil flows among oil passages 42*a* to 42*d*, extending toward the inner peripheral surfaces of bearing bosses 31*a* to 31*d* from pressure oil ducts 39 of rocker shafts 28 and 29.

Oil dropping passages 64 are formed on a lower surface of oil chamber 61 immediately above valve end sections 63, similar to that of the first embodiment.

Figure 8:
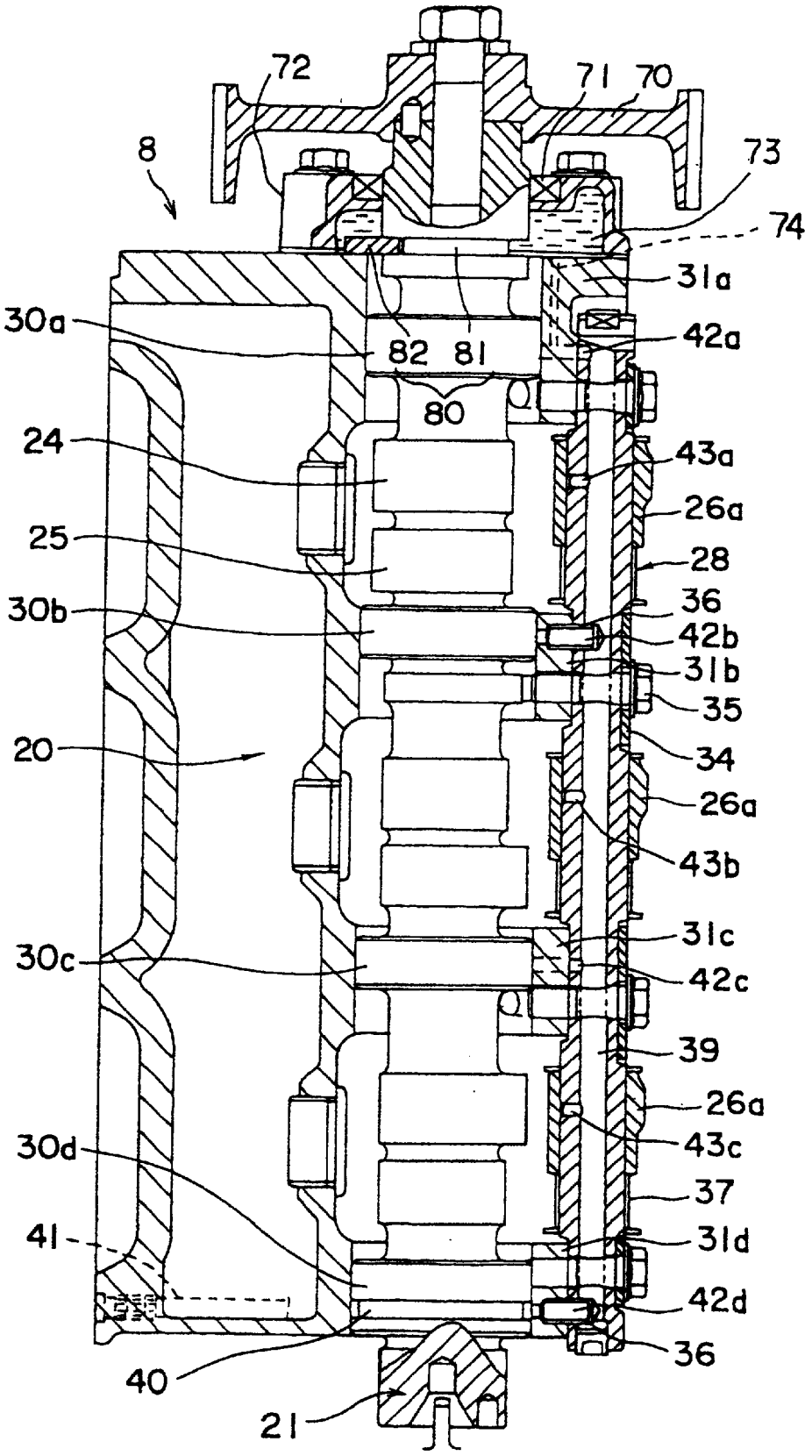
FIG. 8 is a rear view showing a cylinder head of the outboard engine according to a third embodiment of the present invention.

Referring to FIG. 8, according to a third embodiment of the present invention, an engine (not shown), provided with cylinder head 8, includes a cam driven pulley 70 on an upper end of cam shaft 21. Cam driven pulley 70 is the drive mechanism of cam shaft 21, receiving rotation from crank shaft 11, transmitted through a timing belt (not shown).

Further, the upper end of cam shaft 21 extends outside cylinder head 8, so that an oil seal 71 is provided around a projecting portion of cam shaft 21. Oil seal 71 is held by a seal housing 72.

Seal housing 72 is preferably cover-shaped in a similar manner to upper cover 60 in the above described second embodiment. Seal housing 72 includes an oil chamber 73 formed therein as a closed space. An oil branch passage 74, which is another oil passage leading toward oil chamber 73, is formed at midsection of oil passage 42*a*, which extends toward bearing journal 30*a* at the upper end of cam shaft 21. As in the first and second embodiments, oil flows among oil passages 42*a* to 42*d*, which extend toward the inner peripheral surfaces of bearing bosses 31*a* to 31*d* from pressure oil ducts 39 of rocker shafts 28 and 29.

Further, although not shown in details, oil dropping passages (not shown) are formed on a lower surface of oil chamber 73 immediately above the valve end sections, similar to those in the first and second embodiments of the present invention.

Cam shaft 21, in engine 3, in the respective embodiments of the invention, is positioned vertically, similar to crank shaft 11, so that a thrust force acting in an axial direction on cam shaft 21 is born by a thrust bearing construction 80 provided in cylinder head 8, in which cam shaft 21 is housed.

Referring now to FIGS. 7 and 8, an upper portion of cam shaft 21 has a peripheral groove 81, which constitutes thrust bearing construction 80. A thrust plate 82, which is in the form of, for example, a sheet constituting another thrust bearing construction 80, is fixed to an upper surface of cylinder head 8 in oil chamber 61 or 73. Thrust plate 82 fits into peripheral groove 81 on cam shaft 21 to bear a thrust force acting in the axial direction of cam shaft 21.

An action of the embodiment will be described hereinafter.

Oil chamber 50, being a closed space, is formed above bearing boss 31*a*, which supports an upper end of cam shaft 21. Oil chamber 50 is integral with cylinder head 8 (the first embodiment), or upper cover 60 and seal housing 72 are used to form oil chambers 61 and 73 separately (the second and third embodiments) so as to conduct the lubricating oil, introduced into pressure oil ducts 39 of rocker shafts 28 and 29, inside oil chambers 50, 61, and 73 through oil passage 42a and oil branch passages 52, 62, and 74, each of which serves as another oil passage. Oil dropping passages 54 and 64 are formed on a lower surface of oil chamber 50, 61, and 73 immediately above valve end sections 53 and 63, whereby the lubricating oil in oil chamber 50, 61, and 73 drops onto valve end sections 53 and 63 from oil dropping passages 54 and 64 to adequately lubricate valve end sections 53 and 63. In particular, the valve end sections for the cylinders, disposed above are exposed directly to the lubricating oil, so that the need of setting the hardness of the valve end sections higher relative to normal case is eliminated, thereby reducing manufacturing costs.

Oil chamber 61 and 73, being a closed space, is provided above cylinder head 8, which makes it possible to arrange thrust bearing construction 80 in oil chamber 61 and 73. As a result, thrust bearing construction 80 is improved in freedom in terms of layout, becoming possible to simply mount and dismount, so that mounting and dismounting of cam shaft 21 are made easy, thereby improving assembly quality and maintenance.

As described above, a lubricating construction for outboard motors, which comprise a valve gear device, such as a cam shaft and the like, provided in a cylinder head of an engine and a drive mechanism of the cam shaft provided at a lower end of the cam shaft, according to the present invention, includes a closed space formed above a bearing boss, which supports an upper end of the cam shaft. This closed space is integrally formed with the cylinder head. Oil passages in the cylinder head conduct a lubricating oil into the closed space. Oil dropping passages, formed on a lower surface of the oil chamber immediately above the valve gear device, cause oil to drop onto the valve gear device, whereby sufficient lubrication is provided for, in particular, valve end sections of the valve gear device, thereby improving performance and reducing cost. A thrust bearing construction is preferably arranged in the closed space to improve freedom in terms of layout of the thrust bearing construction, as well as qualities of assembly and maintenance for the cam shaft.

A lubricating construction for outboard motors, which has a valve gear device, such as a cam shaft and the like, provided in a cylinder head of an engine and a drive mechanism of the cam shaft provided at a lower end of the cam shaft, according to the present invention, includes a cover member provided above a bearing boss, which supports an upper end of the cam shaft. A closed space is provided in the cover member to be separate from the cylinder head. Oil passages are provided in the cylinder head for conducting a lubricating oil into the closed space, and oil dropping passages are formed on a lower surface of the closed space immediately above the valve gear device, through which the lubricating oil in the closed space is made to drop onto the valve gear device. This provides sufficient lubrication for, in particular, valve end sections of the valve gear device to improve performance and reduce cost. A thrust bearing construction can be arranged in the closed space to improve freedom in terms of layout of the thrust bearing construction, as well as qualities of assembly and maintenance for the cam shaft.

Further, a lubricating construction for outboard motors, which has a valve gear device, such as a cam shaft and the like, provided in a cylinder head of an engine and a drive mechanism of the cam shaft provided at an upper end of the cam shaft, according to the present invention, includes a seal housing provided above the cylinder head to support an upper end of the cam shaft. A closed space is provided in the seal housing to be separate from the cylinder head. Oil passages are provided in the cylinder head for conducting a lubricating oil into the closed space. Oil dropping passages are formed on a lower surface of the closed space immediately above the valve gear device, through which the lubricating oil in the closed space is made to drop onto the valve gear device. This provides sufficient lubrication for, in particular, valve end sections of the valve gear device to improve performance and reduce cost. A thrust bearing construction can be arranged in the closed space to improve freedom in terms of layout of the thrust bearing construction, as well as qualities of assembly and maintenance for the cam shaft.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A lubricating system for an engine comprising:

at least one element in said engine requiring lubrication;

said at least one element Includes a plurality of elements vertically aligned with each other, whereby said lubricating fluid contacts at least first and second of said plurality of elements as it passes by gravity through said engine;

an oil chamber vertically disposed above said at least one element;

means for admitting lubricating fluid to said oil chamber; and at least one oil dropping passage permitting said lubricating fluid to pass from said oil chamber onto said at least one element, whereby said at least one element is lubricated.

2. A lubricating system for an engine according to claim 1, wherein said plurality of elements includes rocker arms of said engine, and valve stems of said engine, whereby friction points between said rocker arms and said valve stems are lubricated.

3. A lubricating system for an engine according to claim 1, wherein:

said at least one oil dropping passage includes a first oil dropping passage and a second oil dropping passage;

said first oil dropping passage being substantially vertically aligned with said first of said plurality of elements; and said second oil dropping passage being substantially vertically aligned with said second of said plurality of element.

4. A lubricating system for an engine according to claim 1, wherein said oil chamber is integrally formed at an upper portion of a cylinder head of said engine.

5. A lubrication system for an engine according to claim 1, further comprising:

a seal housing separate from a cylinder head of said engine;

attachment means for attaching said seal housing vertically above said at least one element; and said oil chamber being enclosed within said seal housing.

6. A lubrication system for an engine comprising:

at least one element in said engine requiring lubrication;

an oil chamber vertically disposed above said at least one element;

means for admiting lubricating fluid to said oil chamber; and at least one oil dropping passage permitting said lubricating fluid to pass from said oil chamber onto said at least one element, whereby said at least one element is lubricated;

a cover member separate from a cylinder head of said engine;

attachment means for attaching said cover member vertically above said at least one element; and said oil chamber being enclosed within said cover member.

7. A lubricating system for an engine according to claim 6, wherein said oil chamber is integrally formed at an upper portion of a cylinder head of said engine.

8. A lubrication system for an engine according to claim 6, further comprising:

a seal housing separate from a cylinder head of said engine;

attachment means for attaching said seal housing vertically above said at least one element; and said oil chamber being enclosed within said seal housing.

9. A lubrication system for an engine comprising:

at least one element in said engine requiring lubrication;

an oil chamber vertically disposed above said at least one element;

means for admitting lubricating fluid to said oil chamber; and at least one oil dropping passage petig said lubricating fluid to pass from said oil chamber onto said at least one element, whereby said at least one element is lubricated;

a thrust bearing construction on an upper portion of a cam shaft of said engine;

a peripheral groove on said upper portion of said cam shaft;

a thrust plate attached to an upper surface of a cylinder-head of said engine;

said thrust plate positioned within said oil chamber; and said thrust plate fitting into said peripheral groove to bear a thrust force acting in an axial direction of said cam shaft.

10. A lubricating system for an engine according to claim 9, wherein said oil chamber is integrally formed at an upper portion of a cylinder head of said engine.

11. A lubrication system for an engine according to claim 9, further comprising:

a seal housing separate from a cylinder head of said engine;

attachment means for attaching said seal housing vertically above said at least one element; and said oil chamber being enclosed within said seal housing.

* * * * *